US010023451B2

(12) United States Patent
Tsuruta et al.

(10) Patent No.: US 10,023,451 B2
(45) Date of Patent: Jul. 17, 2018

(54) FORKLIFT

(75) Inventors: Megumu Tsuruta, Tokyo (JP); Masataka Kawaguchi, Tokyo (JP); Kensuke Futahashi, Tokyo (JP); Naohito Hashimoto, Tokyo (JP)

(73) Assignee: MITSUBISHI NICHIYU FORKLIFT CO., LTD., Nagaokakyo-shi, Kyoto (JP)

( * ) Notice: Subject to any disclaimer, the term of this patent is extended or adjusted under 35 U.S.C. 154(b) by 203 days.

(21) Appl. No.: 14/347,971

(22) PCT Filed: Feb. 7, 2012

(86) PCT No.: PCT/JP2012/052753
§ 371 (c)(1),
(2), (4) Date: Mar. 27, 2014

(87) PCT Pub. No.: WO2013/046738
PCT Pub. Date: Apr. 4, 2013

(65) Prior Publication Data

US 2014/0241840 A1 Aug. 28, 2014

(30) Foreign Application Priority Data

Sep. 27, 2011 (JP) ..... 2011-211245

(51) Int. Cl.
*B66F 17/00* (2006.01)
*B66F 9/07* (2006.01)
*B66F 9/08* (2006.01)
*B66F 9/22* (2006.01)

(52) U.S. Cl.
CPC ..... *B66F 17/003* (2013.01); *B66F 9/07* (2013.01); *B66F 9/082* (2013.01); *B66F 9/22* (2013.01)

(58) Field of Classification Search
CPC ..... B66F 17/003; B66F 9/22; B66F 9/082; B66F 9/07
See application file for complete search history.

(56) References Cited

U.S. PATENT DOCUMENTS 2,938,351 A * 5/1960 Brooks ..... F15B 11/22 414/619
3,831,492 A * 8/1974 Young ..... B66F 17/003 137/596.18

(Continued)

FOREIGN PATENT DOCUMENTS

CN 2058178 U 6/1990
CN 1628071 A 6/2005

(Continued)

OTHER PUBLICATIONS

Office Action dated Apr. 28, 2015 for Chinese Application No. 201280047439.9 with an English translation.

(Continued)

*Primary Examiner* — Anna M Momper
*Assistant Examiner* — Ashley K Romano
(74) *Attorney, Agent, or Firm* — Birch, Stewart, Kolasch & Birch, LLP

(57) ABSTRACT

A forklift includes a forklift body having a front wheel and a rear wheel, a fork supported to the front of the forklift body so as to be capable of moving vertically via a mast, a lift cylinder capable of moving the fork up and down, a hydraulic pressure supply line capable of supplying hydraulic pressure to a head-side chamber in the lift cylinder, a hydraulic pressure exhaust line capable of exhausting hydraulic pressure from a rod-side chamber in the lift cylinder, and a changeover valve provided on the hydraulic pressure exhaust line, wherein a control device changes a pressure balance between hydraulic pressure on the head-side chamber and hydraulic pressure on the rod-side chamber in the lift cylinder by the changeover valve to restrict the operation of the lift cylinder, when a weight of a load on the fork exceeds a limit load weight.

12 Claims, 7 Drawing Sheets

(56) References Cited

U.S. PATENT DOCUMENTS

| | | | | |
|---|---|---|---|---|
| 7,568,547 | B2 * | 8/2009 | Yamada | B66F 17/003 180/282 |
| 8,678,138 | B2 * | 3/2014 | Rekow | B66F 9/07545 187/222 |
| 8,779,306 | B2 * | 7/2014 | Gauthier | G01G 3/10 177/147 |
| 2004/0031649 | A1 * | 2/2004 | Schiebel | B66F 17/003 187/223 |

FOREIGN PATENT DOCUMENTS

| | | | |
|---|---|---|---|
| CN | 201301204 | Y | 2/2009 |
| CN | 101580207 | A | 11/2009 |
| DE | 1406784 | A1 | 4/1969 |
| JP | 2006-137596 | A | 6/2006 |
| JP | 2010-189129 | A | 9/2010 |

OTHER PUBLICATIONS

Extended European Search Report dated Feb. 19, 2015 issued in corresponding European Application No. 12835206.9.
Japanese Decision of a Patent Grant dated Mar. 29, 2016, for Japanese Application No. 2011-211245 with the English translation.
Notice of Allowance dated Nov. 5, 2015 in Chinese Patent Application No. 201280047439.9 with an English Translation.
European Patent Office Communication, dated Feb. 16, 2017, for counterpart European Application No. 12835206.9.

* cited by examiner

FORKLIFT

FIELD

The present invention relates to a forklift for load transportation, and more particularly to a forklift including an overload preventing device that prevents overloading of load on a fork.

BACKGROUND

In a forklift, a mast is supported on its front so as to be capable of tilting by a hydraulic cylinder, and a fork is supported on the mast so as to be capable of moving vertically by a hydraulic cylinder. A control device drives a pump, according to an operation of an operation lever, to supply or exhaust hydraulic pressure to or from each hydraulic cylinder, thereby being capable of allowing the fork to tilt and moving the fork vertically.

A limit load weight by which the fork can safely travel with a load is set to such forklift. Therefore, the forklift is configured such that, when hydraulic pressure supplied from the pump exceeds a predetermined limit pressure, the hydraulic pressure cannot be supplied to each hydraulic cylinder, but to return to a tank by a relief valve.

One example of a forklift provided with an overload preventing device is described in Patent Literature 1. The overload preventing device described in the Patent Literature 1 has a supply line for introducing working fluid ejected from a pump to a cylinder tube, an outlet line for sending the working fluid from the cylinder tube, and a pressure control valve arranged in the middle of a supply line and that connects a drain to a tank, wherein the pressure control valve is used as a sequence valve that opens the drain by using the pressure of the outlet line as a pilot pressure.

CITATION LIST

Patent Literature

Patent Literature 1: Japanese Patent Application Laid-open No. 2010-189129

SUMMARY

Technical Problem

In the conventional overload preventing device of a forklift described above, when a load on the fork has a weight exceeding a permissible weight, static pressure of the working fluid exceeds a valve-opening pressure of the pressure control valve. Accordingly, the working fluid from the pump returns to the tank through the drain line to prevent the working fluid from being supplied to the hydraulic cylinder. According to this configuration, even when the weight of the load does not exceed the permissible weight, the pressure loss of the pressure control valve reduces operation power of the hydraulic cylinder, i.e., power of lifting the load by the fork, because the pressure control valve is arranged in the supply line connected to a head-side of the hydraulic cylinder. Therefore, hydraulic pressure more than necessary has to be assured for lifting the load by the elevating operation of the fork, and this entails a problem of deterioration in fuel economy.

The present invention is accomplished in view of the foregoing problem, and aims to provide a forklift that can prevent deterioration in fuel economy by reducing a pressure loss of a hydraulic pressure supply line.

Solution to Problem

In order to achieve the above mentioned object, a forklift according to the present invention includes a forklift body capable of travelling; a fork supported to the forklift body so as to be capable of moving vertically; a first fluid pressure cylinder capable of moving the fork up and down; a fluid pressure supply line capable of supplying fluid pressure to a head-side in the first fluid pressure cylinder; a fluid pressure exhaust line capable of exhausting fluid pressure from a rod-side in the first fluid pressure cylinder; a changeover valve provided on the fluid pressure exhaust line; and an operation restricting device configured to change a pressure balance between fluid pressure on the head-side and fluid pressure on the rod-side of the first fluid pressure cylinder by the changeover valve to restrict an operation of the first fluid pressure cylinder, when a weight of a load on the fork exceeds a threshold value set in advance.

Accordingly, when a weight of a load on the fork exceeds a threshold value, the operation of the first fluid pressure cylinder is restricted by changing the pressure balance between the fluid pressure on the head-side and the fluid pressure on the rod-side of the first fluid pressure cylinder by the changeover valve. Consequently, the deterioration in fuel economy can be prevented by reducing the pressure loss of the fluid pressure supply line.

In the forklift according to the present invention, the changeover valve is a valve capable of switching to be in an exhaust position for connecting the rod-side of the first fluid pressure cylinder and the fluid pressure exhaust line, and in a communication position for connecting the rod-side and the head-side of the first fluid pressure cylinder, and the operation restricting device switches the changeover valve to be in the communication position, when a weight of a load on the fork exceeds the threshold value.

According to this configuration, when the weight of the load on the fork exceeds the threshold value, the changeover valve is switched to be in the communication position, whereby the rod-side and the head-side of the first fluid pressure cylinder communicate with each other. Consequently, the pressure on the rod-side and the pressure on the head-side become almost equal to each other, whereby the elevating motion of the fork can be restricted.

In the forklift according to the present invention, the changeover valve has an open pressure set corresponding to the threshold value.

According to this configuration, when the weight of the load on the fork exceeds the threshold value, the pressure of the fluid pressure exhaust line reduces, and does not exceed the pressure for opening the changeover valve. Consequently, the elevating motion of the fork can be restricted.

In the forklift according to the present invention, the fork is supported to the forklift body so as to be capable of tilting, and capable of tilting by the second fluid pressure cylinder, the fluid pressure supply line includes a first fluid pressure supply line capable of supplying fluid pressure to the head-side of the first fluid pressure cylinder and a second fluid pressure supply line capable of supplying fluid pressure to the head-side of the second fluid pressure cylinder, a first relief valve and a second relief valve are provided on the first fluid pressure supply line and the second fluid pressure supply line, respectively, and the first relief valve has an open pressure set according to the threshold value.

According to this configuration, the pressure for opening the first relief valve on the first fluid pressure supply line is set according to the threshold value, so that the valve-opening pressure can be set without giving influence to the pressure of the second fluid pressure supply line. Consequently, the elevating motion of the fork can appropriately be restricted.

In the forklift according to the present invention, the operation restricting device restricts an operation of an operation device for moving up the fork, when a weight of a load on the fork exceeds the threshold value.

Accordingly, the operation restricting device can easily restrict the elevating motion of the fork with a simple structure by restricting the operation of the operation device, when the weight of the load on the fork exceeds the threshold value.

In the forklift according to the present invention, the operation restricting device issues an alarm, when a weight of a load on the fork exceeds the threshold value.

Accordingly, the operation restricting device can give a warning to an operator by issuing an alarm, when the weight of the load on the fork exceeds the threshold value. Consequently, the operation restricting device can enhance safety.

In the forklift according to the present invention, a wheel vertical load detecting sensor configured to detect a wheel vertical load on a side opposite to the side where the fork is mounted on the forklift body is further included, and the operation restricting device restricts the operation of the first fluid pressure cylinder, when the wheel vertical load becomes less than a limit vertical load set in advance.

According to this configuration, a wheel vertical load on the side opposite to the side where the fork is mounted is used as a threshold value. This configuration eliminates a need of an arrangement of a pressure sensor on the fluid pressure supply line, thereby being capable of simplifying the structure.

Advantageous Effects of Invention

The forklift according to the present invention includes the changeover valve, which can supply fluid pressure to the head-side of the first fluid pressure cylinder, on the fluid pressure supply line, and when the weight of the load on the fork exceeds the threshold value, the forklift changes the pressure balance between the fluid pressure on the head-side and the fluid pressure on the rod-side of the first fluid pressure cylinder by the changeover valve to restrict the operation of the first fluid pressure cylinder. Consequently, the forklift can reduce a pressure loss on the fluid pressure supply line, thereby being capable of preventing deterioration in fuel economy.

DESCRIPTION OF EMBODIMENTS

Preferable embodiments of a forklift according to the present invention will be described in detail with reference to the drawings. These embodiments do not limit the present invention, and when there are plural embodiments, the present invention includes a configuration made by combining each embodiment.

First Embodiment

Figure 1:
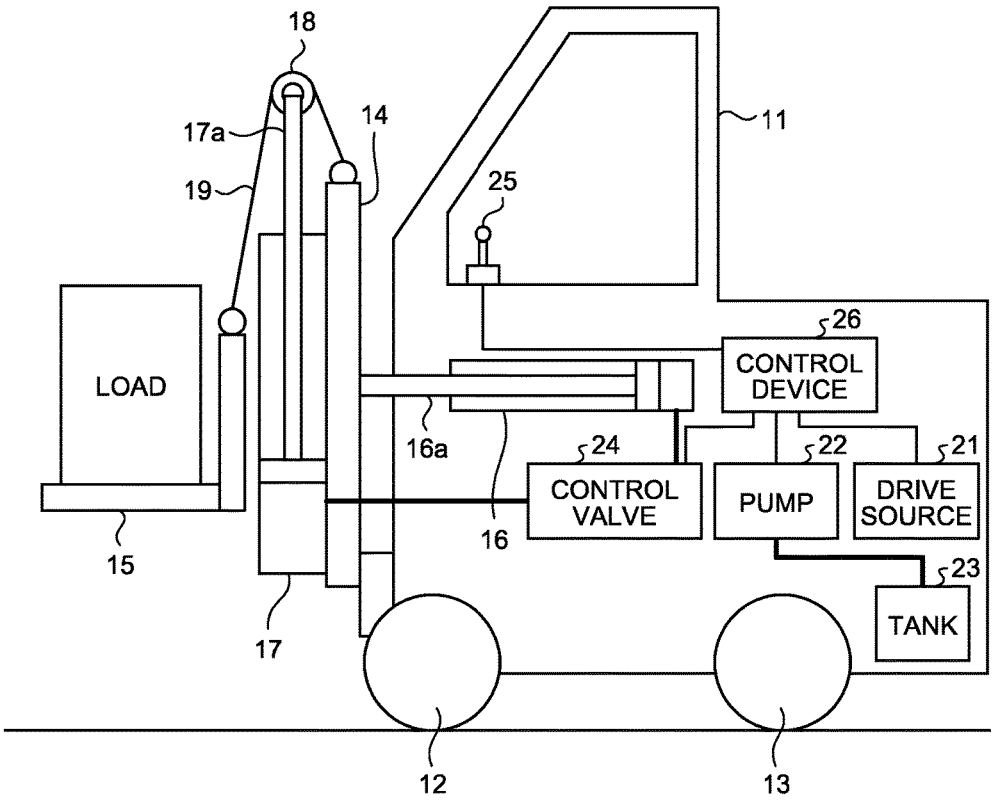
FIG. 1 is a schematic view illustrating a forklift according to a first embodiment of the present invention.
Figure 2:
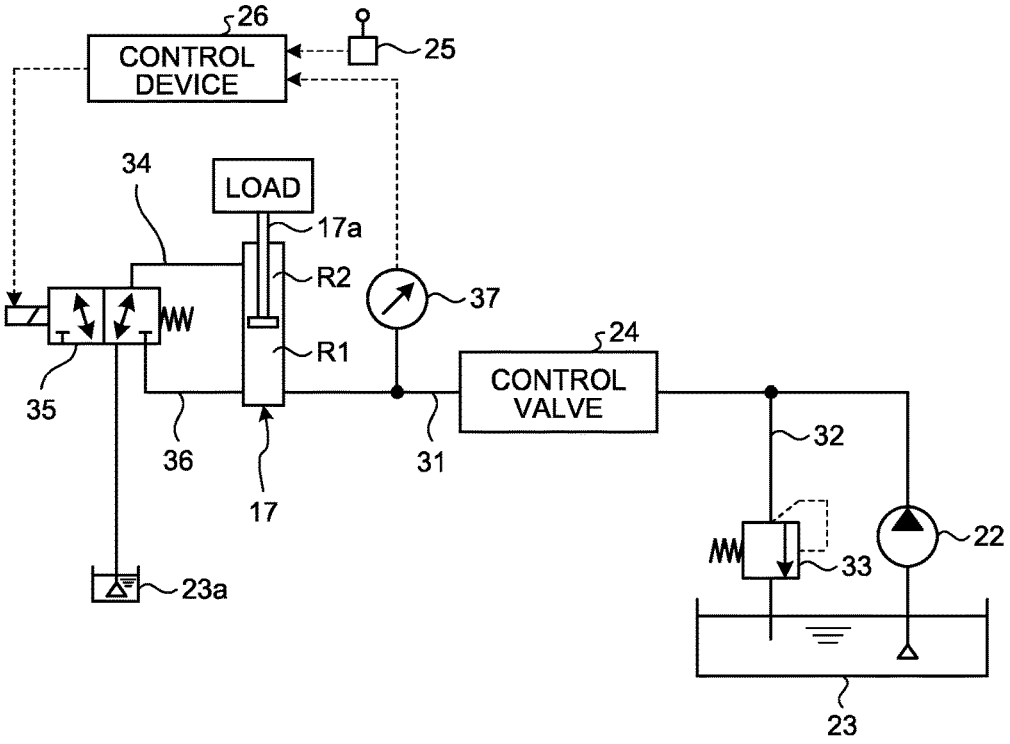
FIG. 2 is a hydraulic pressure circuit diagram of a lift cylinder in the forklift according to the first embodiment.

FIG. 1 is a schematic view of a forklift according to a first embodiment of the present invention, and FIG. 2 is a hydraulic pressure circuit diagram of a lift cylinder in the forklift according to the first embodiment.

As illustrated in FIG. 1, in a forklift according to the first embodiment, a forklift body 11 can travel with two front wheels 12 and two rear wheels 13, and can move forward and backward by driving the front wheels 12 or the rear wheels 13 with a mounted engine (or an electric motor). The forklift body 11 can also travel in a desired direction by steering the rear wheels 13 with an operation handle not illustrated.

A mast 14 is supported on the front of the forklift body 11 so as to be capable of tilting about a lower part thereof, and a fork 15 is supported to the mast 14 so as to be capable of moving vertically (lifting). A tilt cylinder (second fluid pressure cylinder) 16 can move a rod 16*a* by supplying or exhausting hydraulic pressure, and a tip end of the rod 16*a* is coupled to the mast 14. A lift cylinder (first fluid pressure cylinder) 17 can move a rod 17*a* by supplying or exhausting hydraulic pressure, and a guide roller 18 is mounted on a tip end of the rod 17*a*. One end of a wire 19 is coupled to an upper end of the fork 15, a middle part thereof is guided by the guide roller 18, and the other end thereof is coupled to an upper end of the mast 14.

Therefore, when hydraulic pressure is supplied to or exhausted from the tilt cylinder 16, the rod 16*a* moves front-back direction to tilt the mast 14 about its lower part, whereby the fork 15 can be tilted. When hydraulic pressure is supplied to or exhausted from the lift cylinder 17, the rod 17*a* moves vertically to move the wire 19 via the guide roller 18, whereby the fork 15 is pulled and lifted.

A drive source 21 is, for example, an engine (or an electric motor) and capable of applying pressure to working fluid stored in a tank 23 by driving a pump 22. A control valve 24 supplies the working fluid, to which pressure is applied by the pump 22, to the tilt cylinder 16 or the lift cylinder 17, thereby being capable of operating the tilt cylinder 16 or the lift cylinder 17. An operation device 25 can be operated by an operator, and can output an operation signal for tilting or lifting the fork 15. A control device 26 can control to drive the drive source 21, the pump 22, and the control valve 24 based upon the operation signal from the operation device 25.

In the forklift thus configured according to the first embodiment, a limit load weight of a load that can be held by the fork 15 is set in order to realize a safety traveling with load being placed on the fork 15. Specifically, when a load with a weight exceeding the limit load weight is placed on the fork 15, the operation of the fork 15 is restricted in order to prevent the fork 15 from moving up in this case.

As illustrated in FIG. 2, one end of a hydraulic pressure supply line (fluid pressure supply line) 31 is connected to the tank 23, while the other end thereof is connected to a head-side chamber R1 close to a head in the lift cylinder 17. The pump 22 is connected to the side of the hydraulic pressure supply line 31 close to the tank 23, and the control valve 24 is connected to the side close to the lift cylinder 17. A hydraulic pressure return line 32 is branched from the portion between the pump 22 and the control valve 24 on the hydraulic pressure supply line 31, and connected to the tank 23. A relief valve 33 is provided on the hydraulic pressure return line 32.

One end of a hydraulic pressure exhaust line (fluid pressure exhaust line) 34 is connected to a rod-side chamber R2 in the lift cylinder 17 close to the rod, and the other end is connected to a tank 23*a*. The tank 23 and the tank 23*a* may be the same. A changeover valve 35 is provided on the hydraulic pressure exhaust line 34. One end of a hydraulic pressure communication line 36 is connected to the changeover valve 35, while the other end is connected to the head-side chamber R1 in the lift cylinder 17. The changeover valve 35 is an electromagnetic valve. The changeover valve 35 allows the rod-side chamber R2 in the lift cylinder 17 and the tank 23*a* to communicate with each other by the hydraulic pressure exhaust line 34 during de-energization, and allows the rod-side chamber R2 and the head-side chamber R1 in the lift cylinder 17 to communicate with each other by the hydraulic pressure exhaust line 34 and the hydraulic pressure communication line 36 during energization.

A pressure sensor 37 detects hydraulic pressure between the control valve 24 and the lift cylinder 17 on the hydraulic pressure supply line 31, i.e., hydraulic pressure applied to the head-side chamber R1 in the lift cylinder 17, and outputs the detected pressure to the control device 26. The control device 26 switches the changeover valve 35 based upon the hydraulic pressure applied to the chamber R1 and detected by the pressure sensor 37.

Specifically, the control device 26 functions as an operation restricting device according to the present invention. When a weight of a load on the fork 15 exceeds a limit load weight (predetermined threshold value), the control device 26 changes the pressure balance between the hydraulic pressure in the head-side chamber R1 and the hydraulic pressure in the rod-side chamber R2 in the lift cylinder 17 by the changeover valve 35 to restrict the operation of the lift cylinder 17.

As described above, the position of the changeover valve 35 can be switched between an exhaust position for connecting the rod-side chamber R2 in the lift cylinder 17 and the tank 23*a* by the hydraulic pressure exhaust line 34 and a communication position for connecting the rod-side chamber R2 and the head-side chamber R1 in the lift cylinder 17 by the hydraulic pressure exhaust line 34 and the hydraulic pressure communication line 36. The control device 26 energizes the changeover valve 35 to change its position to the communication position in order to allow the rod-side chamber R2 and the head-side chamber R1 in the lift cylinder 17 to communicate with each other, when the weight of the load on the fork 15 exceeds the limit load weight, i.e., when the hydraulic pressure applied to the chamber R1 and detected by the pressure sensor 37 exceeds a limit hydraulic pressure corresponding to the limit load weight.

It is desirable that the limit hydraulic pressure is obtained in advance by experiments as hydraulic pressure corresponding to the limit load weight. It is also desirable that the limit hydraulic pressure is set lower than relief pressure of the relief valve 33.

According to this configuration, when the operator operates the operation device 25 to output an operation signal for lifting the fork 15, the control device 26 drives the pump 22 and drives the control valve 24 based upon the operation signal from the operation device 25. Specifically, the control device 26 supplies predetermined hydraulic pressure to the head-side chamber R1 in the lift cylinder 17 via the hydraulic pressure supply line 31 by the control valve 24. With this operation, the rod 17*a* of the lift cylinder 17 moves up to move the wire 19 via the guide roller 18, whereby the fork 15 is pulled and lifted up. Therefore, the load can be lifted.

In this case, the pressure sensor 37 detects the hydraulic pressure supplied to the head-side chamber R1 in the lift cylinder 17, and outputs the detected pressure to the control device 26. The control device 26 compares the hydraulic pressure applied to the chamber R1 and the limit hydraulic pressure set in advance. When determining that the hydraulic pressure applied to the chamber R1 is not more than the limit hydraulic pressure, the control device 26 keeps the changeover valve 35 in the non-energized state, whereby the rod-side chamber R2 in the lift cylinder 17 and the tank 23*a* communicate with each other by the hydraulic pressure exhaust line 34. Therefore, when the rod 17*a* of the lift cylinder 17 moves up by the supply of the hydraulic pressure to the head-side chamber R1, the hydraulic pressure in the rod-side chamber R2 is exhausted to the tank 23*a* from the hydraulic pressure exhaust line 34, with the result that the lift cylinder 17 appropriately operates to lift the load by the fork 15.

The rod 17*a* of the lift cylinder 17 moves down to lower the fork 15. Therefore, the hydraulic pressure in the head-side chamber R1 is returned to the tank 23 by the control valve 24, while the capacity of the rod-side chamber R2 increases. Accordingly, the hydraulic pressure (working fluid) in the tank 23*a* is drawn into the chamber R2 through the hydraulic pressure exhaust line 34.

On the other hand, when determining that the hydraulic pressure applied to the chamber R1 exceeds the limit hydraulic pressure, the control device 26 energizes the changeover valve 35, whereby the rod-side chamber R2 and the head-side chamber R1 in the lift cylinder 17 communicate with each other by the hydraulic pressure exhaust line 34 and the hydraulic pressure communication line 36. Therefore, even when the hydraulic pressure is supplied to the head-side chamber R1, this hydraulic pressure flows into the rod-side chamber R2 through the hydraulic pressure exhaust line 34 and the hydraulic pressure communication line 36, whereby the hydraulic pressure in the head-side chamber R1 and the hydraulic pressure in the rod-side chamber R2 become almost equal to each other. Accordingly, the lift cylinder 17 cannot move up the rod 17*a*. In other words, when a load with a weight exceeding the limit load weight is placed on the fork 15, the control device 26 restricts the elevating motion of the fork 15 to prevent the damage on various components including the fork 15 and the lift cylinder 17.

As described above, the forklift according to the first embodiment includes the forklift body 11 having front wheels 12 and rear wheels 13, the fork 15 that is supported on the front of the forklift body 11 so as to be capable of moving up and down via the mast 14, the lift cylinder 17 that can move the fork 15 up and down, the hydraulic pressure supply line 31 that can supply hydraulic pressure to the head-side chamber R1 in the lift cylinder 17, the hydraulic pressure exhaust line 34 that can exhaust hydraulic pressure from the rod-side chamber R2 in the lift cylinder 17, and the changeover valve 35 provided on the hydraulic pressure exhaust line 34, wherein the control device 26 changes the pressure balance between the hydraulic pressure in the head-side chamber R1 and the hydraulic pressure in the rod-side chamber R2 in the lift cylinder 17 by the changeover valve 35 to restrict the operation of the lift cylinder 17, when a weight of a load on the fork 15 exceeds the limit load weight.

When the weight of the load on the fork 15 exceeds the limit load weight, the control device 26 changes the pressure balance between the hydraulic pressure in the head-side chamber R1 and the hydraulic pressure in the rod-side chamber R2 in the lift cylinder 17 by the changeover valve 35. Specifically, the control device 26 allows the head-side chamber R1 and the rod-side chamber R2 in the lift cylinder 17 to communicate with each other by the changeover valve 35 to make the hydraulic pressure in the chamber R1 and the hydraulic pressure in the chamber R2 equal to each other. Accordingly, even when the hydraulic pressure is supplied to the head-side chamber R1, the lift cylinder 17 cannot operate the rod 17*a*. Consequently, the control device 26 restricts the elevating motion of the fork 15, thereby being capable of preventing the damage on various components, when a load with the weight exceeding the limit load weight is placed on the fork 15.

Since the flow path area in the rod-side chamber R2 close to the rod 17*a* is smaller than that of the head-side chamber R1 in the lift cylinder 17, the changeover valve 35 can be provided not on the hydraulic pressure supply line 31 but on the hydraulic pressure exhaust line 34. With this configuration, the pressure loss can be reduced, whereby deterioration in fuel economy can be prevented.

In the forklift according to the first embodiment, the rod-side chamber R2 in the lift cylinder 17 and the tank 23*a* are connected by the hydraulic pressure exhaust line 34, wherein the changeover valve 35 is provided on the hydraulic pressure exhaust line 34, and the changeover valve 35 and the head-side chamber R1 in the lift cylinder 17 are connected to each other by the hydraulic pressure communication line 36. During the non-energization of the changeover valve 35, the rod-side chamber R2 in the lift cylinder 17 and the tank 23*a* communicate with each other by the hydraulic pressure exhaust line 34, while the rod-side chamber R2 and the head-side chamber R1 in the lift cylinder 17 communicate with each other by the hydraulic pressure exhaust line 34 and the hydraulic pressure communication line 36 during energization. The control device 26 energizes the changeover valve 35, when the pressure in the head-side chamber R1 in the lift cylinder 17 exceeds the limit hydraulic pressure of the fork 15.

Since the changeover valve 35 is energized when the pressure in the head-side chamber R1 in the lift cylinder 17 exceeds the limit hydraulic pressure of the fork 15, the hydraulic pressure in the chamber R1 and the hydraulic pressure in the chamber R2 become equal to each other, whereby the operation of the lift cylinder 17 is restricted. Accordingly, the elevating motion of the fork 15 is restricted to prevent the damage on various components, when a load with a weight exceeding the limit load weight is placed on the fork 15.

Second Embodiment

Figure 3:
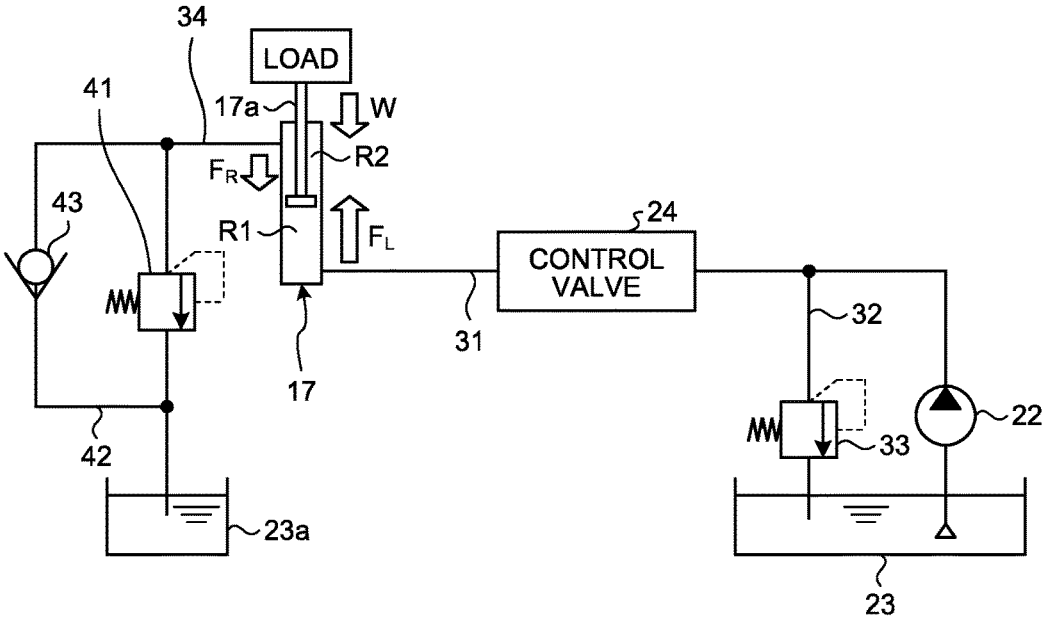
FIG. 3 is a hydraulic pressure circuit diagram of a lift cylinder in a forklift according to a second embodiment of the present invention.

FIG. 3 is a hydraulic pressure circuit diagram of a lift cylinder in a forklift according to a second embodiment of the present invention. The basic configuration of the forklift according to the present embodiment is almost equal to that described above in the first embodiment. Therefore, the present embodiment will be described with reference to FIG. 1. The components having the function same as the function of the components in the above-mentioned embodiment are identified by the same numerals, and the detailed description will not be repeated.

As illustrated in FIG. 3, in the forklift according to the second embodiment, one end of a hydraulic pressure supply line 31 is connected to a tank 23, while the other end thereof is connected to a head-side chamber R1 in a lift cylinder 17. A pump 22 and a control valve 24 are mounted on a hydraulic pressure supply line 31. One end of a hydraulic pressure exhaust line 34 is connected to a rod-side chamber R2 in the lift cylinder 17, and the other end is connected to a tank 23*a*. A relief valve 41 is provided on the hydraulic pressure exhaust line 34, and a hydraulic pressure bypass line 42 bypassing the relief valve 41 is also mounted thereon. A check valve 43 that prevents a flow of hydraulic pressure from the rod-side chamber R2 in the lift cylinder 17 to the tank 23*a* is mounted on the hydraulic pressure bypass line 42. The relief valve 41 is a pressure control valve. This valve is normally closed, and can be opened according to the hydraulic pressure applied to the hydraulic pressure exhaust line 34 from the rod-side chamber R2 in the lift cylinder 17.

Specifically, an open pressure corresponding to the limit load weight is set to the relief valve 41. It is desirable that the open pressure is set in advance by experiments as the hydraulic pressure corresponding to the limit load weight. It is also preferable that the open pressure is set lower than the relief pressure of the relief valve 33. According to this configuration, when the hydraulic pressure in the rod-side chamber R2 (hydraulic pressure exhaust line 34) in the lift cylinder 17 exceeds the open pressure, the relief valve 41 is opened. Specifically, the open pressure of the relief valve 41 is set in order that the push-down force ($W_L+F_R$) of the rod 17*a*, which force is a sum of the limit load weight $W_L$ and the open force (open pressure) $F_R$ of the relief valve 41, balances the maximum push-up force ($F_L$) of the rod 17*a*, which force is the maximum hydraulic pressure of the head-side chamber R1 in the lift cylinder 17.

With this configuration, when an operator operates an operation device 25 to output an operation signal for lifting a fork 15, a control device 26 drives the pump 22 and drives the control valve 24 based upon the operation signal from the operation device 25, as illustrated in FIGS. 1 and 3. Specifically, the control device 26 supplies predetermined hydraulic pressure to the head-side chamber R1 in the lift cylinder 17 via the hydraulic pressure supply line 31 by the control valve 24. With this operation, a rod 17*a* in the lift cylinder 17 moves up to move a wire 19 via a guide roller 18, whereby the fork 15 is pulled and lifted up. Therefore, the load can be lifted.

In this case, when a weight of a load on the fork 15 is not more than the limit load weight, the push-down force ($W+F_R$) of the rod 17*a*, which force is the sum of the load weight W and the open force (open pressure) $F_R$ of the relief valve 41, becomes smaller than the maximum push-up force $F_L$ of the rod 17*a*, which force is the maximum hydraulic pressure in the head-side chamber R1 in the lift cylinder 17, whereby the relief valve 41 is opened. When the rod 17*a* moves up by the supply of hydraulic pressure to the head-side chamber R1, the hydraulic pressure in the rod-side chamber R2 is exhausted to the tank 23*a* from the hydraulic pressure exhaust line 34, with the result that the lift cylinder 17 appropriately operates to lift the load by the fork 15.

The rod 17*a* of the lift cylinder 17 moves down to lower the fork 15. Therefore, the hydraulic pressure in the head-side chamber R1 is returned to the tank 23 by the control valve 24, while the capacity of the rod-side chamber R2 increases. Accordingly, the hydraulic pressure (working fluid) in the tank 23*a* is drawn into the chamber R2 through the hydraulic pressure exhaust line 34 and the hydraulic pressure bypass line 42.

On the other hand, when the weight of the load on the fork 15 exceeds the limit load weight, the push-down force ($W+F_R$) of the rod 17*a*, which force is the sum of the load weight W and the open force (open pressure) $F_R$ of the relief valve 41, becomes larger than the maximum push-up force $F_L$ of the rod 17*a*, which force is the maximum hydraulic pressure in the head-side chamber R1 in the lift cylinder 17, whereby the relief valve 41 is not opened. Therefore, even when the hydraulic pressure is supplied to the head-side chamber R1, the hydraulic pressure in the rod-side chamber R2 is not exhausted to the tank 23*a* from the hydraulic pressure exhaust line 34, whereby the rod 17*a* cannot move up in the lift cylinder 17. In other words, when a load with a weight exceeding the limit load weight is placed on the fork 15, the control device 26 restricts the elevating motion of the fork 15 to prevent the damage on various components including the fork 15 and the lift cylinder 17.

As described above, in the forklift according to the second embodiment, the rod-side chamber R2 in the lift cylinder 17 and the tank 23*a* are connected by the hydraulic pressure exhaust line 34, and the relief valve 41 is mounted on the hydraulic pressure exhaust line 34, wherein the open pressure of the relief valve 41 is set corresponding to the limit load weight of the fork 15. Specifically, the open pressure of the relief valve 41 is set in order that the push-down force ($W_L+F_R$) of the rod 17*a*, which force is a sum of the limit load weight $W_L$ and the open force $F_R$ of the relief valve 41, balances the maximum push-up force $F_L$ of the rod 17*a*, which force is the maximum hydraulic pressure of the head-side chamber R1 in the lift cylinder 17.

Accordingly, when the weight of the load on the fork 15 exceeds the limit load weight, the pressure of the hydraulic pressure exhaust line 34 decreases, and does not exceed the open pressure of the relief valve 41. Therefore, the pressure in the rod-side chamber R2 in the lift cylinder 17 does not decrease, so that the operation of the lift cylinder 17 is restricted to restrict the elevating motion of the fork 15. Consequently, the damage of various devices can be prevented. The device can be simplified, and made compact only by providing the relief valve 41, or the like.

Third Embodiment

Figure 4:
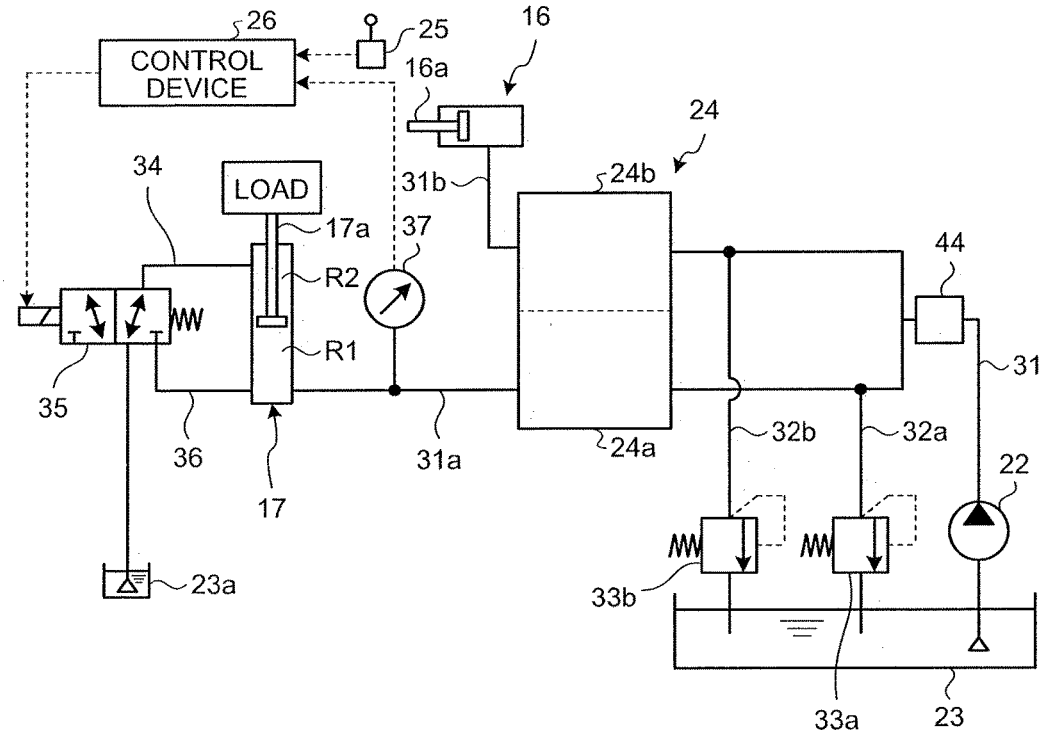
FIG. 4 is a hydraulic pressure circuit diagram of each cylinder in a forklift according to a third embodiment of the present invention.
Figure 5:
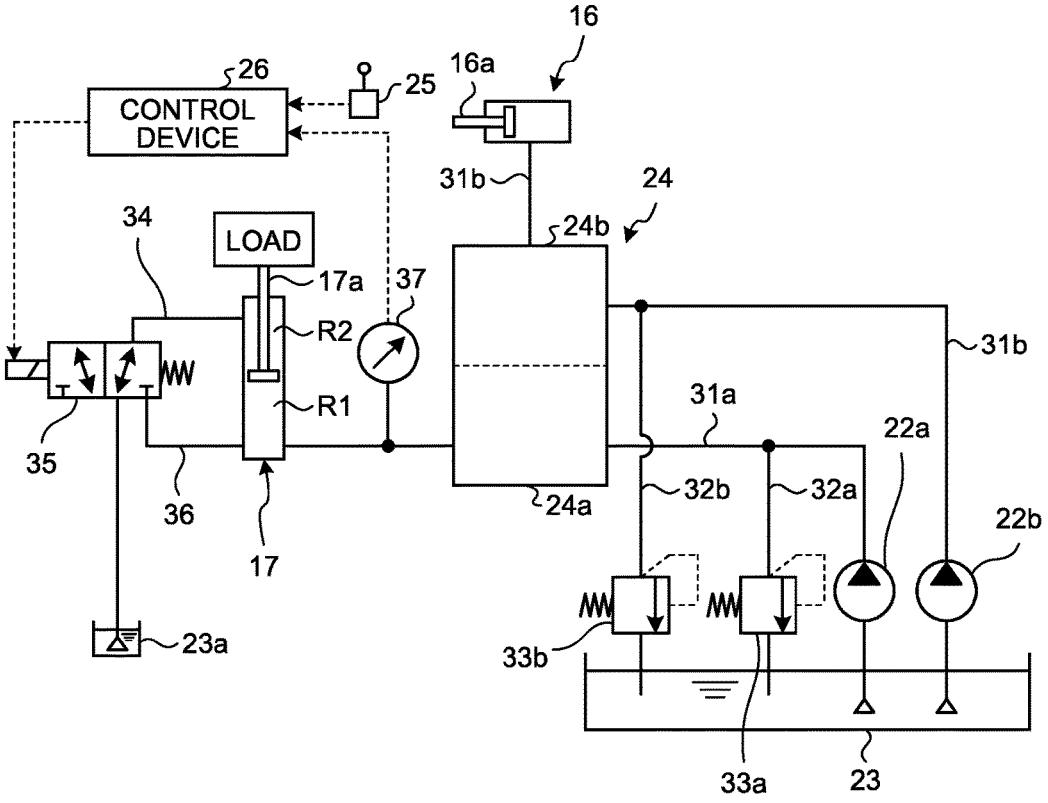
FIG. 5 is a hydraulic pressure circuit diagram of each cylinder in the forklift according to a modification of the third embodiment.

FIG. 4 is a hydraulic pressure circuit diagram of a lift cylinder in a forklift according to a third embodiment of the present invention, and FIG. 5 is a hydraulic pressure circuit diagram of a lift cylinder in a forklift according to a modification of the third embodiment of the present invention. The basic configuration of the forklift according to the present embodiment is almost equal to that described above in the first embodiment. Therefore, the present embodiment will be described with reference to FIG. 1. The components having the function same as the function of the components in the above-mentioned embodiment are identified by the same numerals, and the detailed description will not be repeated.

As illustrated in FIGS. 1 and 4, in the forklift according to the third embodiment, one end of a hydraulic pressure supply line 31 is connected to a tank 23, while the other end thereof is branched into a first hydraulic pressure supply line 31*a* and a second hydraulic pressure supply line 31*b* by a flow dividing valve 44. The first hydraulic pressure supply line 31*a* is connected to a lift cylinder 17, and the second hydraulic pressure supply line 31*b* is connected to a tilt cylinder 16. A pump 22 is connected to the hydraulic pressure supply line 31, and a control valve 24 (24*a*, 24*b*) is mounted on the first and second hydraulic pressure supply lines 31*a* and 31*b*.

First and second hydraulic pressure return lines 32*a* and 32*b* are branched from a portion between the pump 22 and the control valve 24 on the first and second hydraulic pressure supply lines 31*a* and 31*b* to be connected to the tank 23, and first and second relief valves 33*a* and 33*b* are respectively provided on the first and second hydraulic pressure return lines 32*a* and 32*b*. An open pressure corresponding to a limit load weight of a fork 15 is set to the first relief valve 33*a*.

The configuration of the lift cylinder 17 and the configuration on the side of the hydraulic pressure exhaust line 34 are the same as the configuration in the first embodiment, so that the detailed description will not be repeated.

With this configuration, when an operator operates an operation device 25 to output an operation signal for lifting the fork 15, a control device 26 drives the pump 22 and drives the control valve 24 based upon an operation signal from an operation device 25. Specifically, the control device 26 supplies predetermined hydraulic pressure to a head-side chamber R1 in the lift cylinder 17 via the hydraulic pressure supply line 31 by the control valve 24. With this operation, a rod 17*a* moves up in the lift cylinder 17 to move a wire 19 via a guide roller 18, whereby the fork 15 is pulled and lifted up. Therefore, the load can be lifted.

In this case, when a weight of a load on the fork 15 is not more than the limit load weight, the hydraulic pressure of the first hydraulic pressure supply line 31*a* becomes lower than the open pressure of the first relief valve 33*a*, so that the first relief valve 33*a* is closed. Accordingly, the hydraulic pressure is appropriately supplied to the head-side chamber R1 in the lift cylinder 17, whereby the load can be lifted by the fork 15.

On the other hand, when the weight of the load on the fork 15 exceeds the limit load weight, the hydraulic pressure of the first hydraulic pressure supply line 31*a* becomes higher than the open pressure of the first relief valve 33*a*. With this, the first relief valve 33*a* is opened, so that the hydraulic pressure in the first hydraulic pressure supply line 31*a* returns to the tank 23 through the first hydraulic pressure return line 32*a*. Accordingly, the hydraulic pressure is not supplied to the head-side chamber R1 in the lift cylinder 17, resulting in that the rod 17*a* in the lift cylinder 17 cannot move up. Consequently, the damage of various devices including the fork 15 and the lift cylinder 17 can be prevented.

The configuration of the forklift according to the third embodiment is not limited to the above-mentioned configuration. For example, one end of the first hydraulic pressure supply line 31*a* is connected to the tank 23, while the other end thereof is connected to the lift cylinder 17 as illustrated in FIG. 5. One end of the second hydraulic pressure supply line 31*b* is connected to the tank 23, while the other end is connected to the tilt cylinder 16. A first pump 22*a* is mounted to the first hydraulic pressure supply line 31*a*, and a second pump 22*b* is mounted to the second hydraulic pressure supply line 31*b*. The other configuration is the same.

Specifically, the first and second hydraulic pressure supply lines 31*a* and 31*b* including respectively the first and second pumps 22*a* and 22*b* may independently be provided.

As described above, in the forklift according to the third embodiment, the fork 15 is supported to be capable of tilting by the tilt cylinder 16 and to be capable of moving up and down by the lift cylinder 17, the first hydraulic pressure supply line 31*a* is connected to the lift cylinder 17, the first hydraulic pressure return line 32*a* having the first relief valve 33*a* is connected to the first hydraulic pressure supply line 31*a*, the second hydraulic pressure supply line 31*b* is connected to the tilt cylinder 16, the second hydraulic pressure return line 32*b* is connected to the second hydraulic pressure supply line 31*b*, and the open pressure of the first relief valve 33*a* is set corresponding to the limit load weight of the fork 15.

Therefore, when a weight of a load on the fork 15 exceeds the limit load weight, the pressure of the first hydraulic pressure supply line 31*a* increases to exceed the open pressure of the first relief valve 33*a*. With this, the hydraulic pressure of the first hydraulic pressure supply line 31*a* is returned to the tank 23 by the first hydraulic pressure return line 32*a*, whereby the operation of the lift cylinder 17 is restricted to restrict the elevating motion of the fork 15. Consequently, the damage of various components can be prevented. The open pressure of the first relief valve 33*a* on the first hydraulic pressure supply line 31*a* is set according to a weight of a load on the fork 15. Therefore, the open pressure can be set without giving influence to the pressure of the second hydraulic pressure supply line 31*b*, whereby the elevating motion of the fork 15 can appropriately be restricted.

Fourth Embodiment

Figure 6:
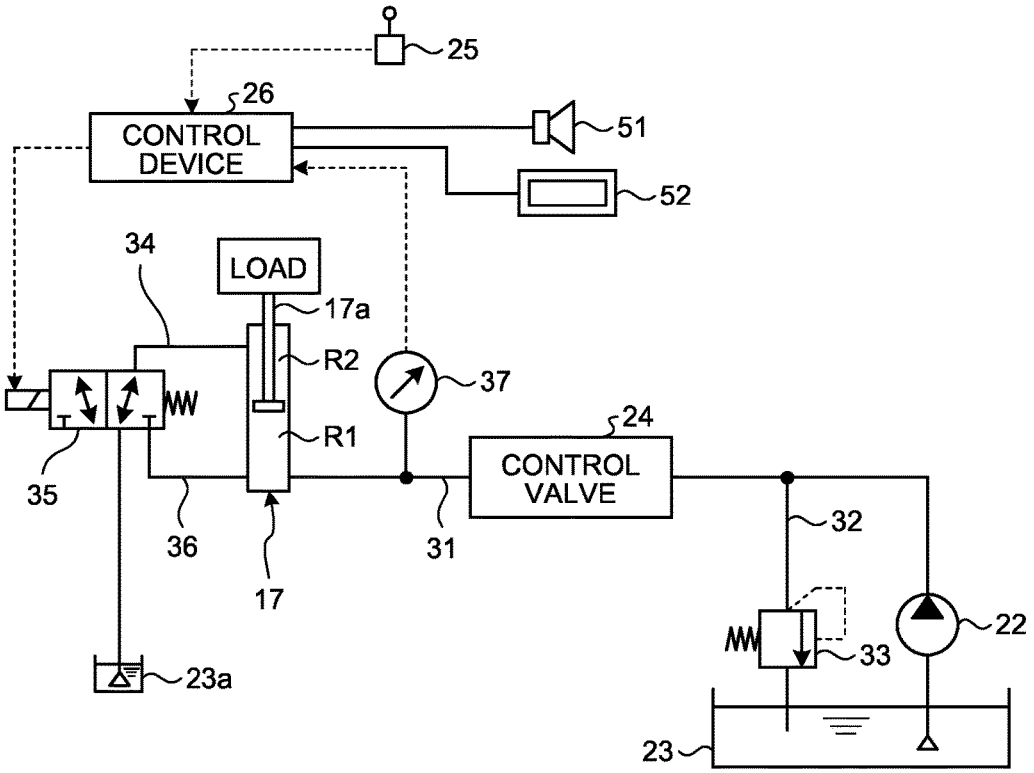
FIG. 6 is a hydraulic pressure circuit diagram of a lift cylinder in a forklift according to a fourth embodiment of the present invention.

FIG. 6 is a hydraulic pressure circuit diagram of a lift cylinder in a forklift according to a fourth embodiment of the present invention. The basic configuration of the forklift according to the present embodiment is almost equal to that described above in the first embodiment. Therefore, the present embodiment will be described with reference to FIG. 1. The components having the function same as the function of the components in the above-mentioned embodiment are identified by the same numerals, and the detailed description will not be repeated.

As illustrated in FIGS. 1 and 6, in the forklift according to the fourth embodiment, one end of a hydraulic pressure supply line 31 is connected to a tank 23, while the other end thereof is connected to a head-side chamber R1 in a lift cylinder 17. A pump 22 and a control valve 24 are mounted on the hydraulic pressure supply line 31. One end of a hydraulic pressure exhaust line 34 is connected to a rod-side chamber R2 in the lift cylinder 17, and the other end is connected to a tank 23*a*. A changeover valve 35 is provided on the hydraulic pressure exhaust line 34. One end of a hydraulic pressure communication line 36 is connected to the changeover valve 35, while the other end thereof is connected to the head-side chamber R1 in the lift cylinder 17. The changeover valve 35 allows the rod-side chamber R2 and the head-side chamber R1 in the lift cylinder 17 to communicate with each other by the hydraulic pressure exhaust line 34 and the hydraulic pressure communication line 36 during energization.

When a weight of a load on a fork 15 exceeds a limit load weight, i.e., when the hydraulic pressure applied to the chamber R1 and detected by a pressure sensor 37 exceeds a limit hydraulic pressure corresponding to the limit load weight, a control device 26 energizes the changeover valve 35 to switch the changeover valve 35 to be in a communication position for allowing the rod-side chamber R2 and the head-side chamber R1 in the lift cylinder 17 to communicate with each other.

When a weight of a load on the fork 15 exceeds the limit load weight, the control device 26 restricts the operation of an operation device 25 for elevating the fork 15. Specifically, the control device 26 not only makes the switching operation of the changeover valve 35 but also rejects an input of an operation signal for elevating the fork 15 from the operation device 25. Alternatively, the control device 26 not only makes the switching operation of the changeover valve 35 but also inhibits the operation of the operation device 25 by a restraint device not illustrated.

A speaker 51 and a display unit (display, or the like) 52, serving as an alarm, are connected to the control device 26. When a weight of a load on the fork 15 exceeds the limit load weight, a sound alarm is issued from the speaker 51, and an alarm display is generated on the display unit 52.

With this configuration, when an operator operates the operation device 25 to output an operation signal for lifting the fork 15, the control device 26 drives the pump 22 and drives the control valve 24 based upon the operation signal from the operation device 25. Specifically, the control device 26 supplies predetermined hydraulic pressure to the head-side chamber R1 in the lift cylinder 17 via the hydraulic pressure supply line 31 by the control valve 24. With this operation, a rod 17*a* moves up in the lift cylinder 17 to move a wire 19 via a guide roller 18, whereby the fork 15 is pulled and lifted up. Therefore, the load can be lifted.

In this case, when determining that a hydraulic pressure applied on the chamber R1 exceeds the limit hydraulic pressure, the control device 26 energizes the changeover valve 35 to allow the rod-side chamber R2 and the head-side chamber R1 in the lift cylinder 17 to communicate with each other by the hydraulic pressure exhaust line 34 and the hydraulic pressure communication line 36. Therefore, even when the hydraulic pressure is supplied to the head-side chamber R1 in the lift cylinder 17, this hydraulic pressure flows into the rod-side chamber R2 through the hydraulic pressure exhaust line 34 and the hydraulic pressure communication line 36, whereby the hydraulic pressure in the head-side chamber R1 and the hydraulic pressure in the rod-side chamber R2 become almost equal to each other. Accordingly, the lift cylinder 17 cannot move up the rod 17*a*. In other words, when a load with a weight exceeding the limit load weight is placed on the fork 15, the control device 26 restricts the elevating motion of the fork 15 to prevent the damage on various components including the fork 15 and the lift cylinder 17.

When determining that the hydraulic pressure applied to the chamber R1 exceeds the limit hydraulic pressure, the control device 26 issues an alarm sound from the speaker 51, and generates an alarm display on the display unit 52. According to this operation, the operator recognizes that the weight of the load on the fork 15 exceeds the limit load weight, and stops the operation of the operation device 25.

When determining that the hydraulic pressure applied to the chamber R1 exceeds the limit hydraulic pressure, the control device 26 issues an alarm sound from the speaker 51, and generates an alarm display on the display unit 52, but the configuration is not limited thereto. For example, when determining that the hydraulic pressure applied to the chamber R1 exceeds 90% of the limit hydraulic pressure, the control device 26 may issue an alarm sound from the speaker 51, and generate an alarm display on the display unit 52, and when determining that the hydraulic pressure applied to the chamber R1 exceeds 100% of the limit hydraulic pressure, the control device 26 may restrict the operation of the lift cylinder 17 by the changeover valve 35 or inhibit the operation of the operation device 25.

As described above, in the forklift according to the fourth embodiment, the control device 26 restricts the operation of the lift cylinder 17 by the changeover valve 35 and restricts the operation of the operation device 25 for elevating the fork 15, when the weight of the load on the fork 15 exceeds the limit load weight.

Accordingly, when the weight of the load on the fork 15 exceeds the limit load weight, the operation of the operation device 25 is inhibited, in addition to the restriction of the operation of the lift cylinder 17 by the changeover valve 35, whereby the elevating motion of the fork 15 can easily be restricted with a simple configuration. In this case, double functions for restricting the elevating motion of the fork 15 are provided, whereby safety is further enhanced.

In the forklift according to the fourth embodiment, when the weight of the load on the fork 15 exceeds the limit load weight, the operation of the lift cylinder 17 is restricted by the changeover valve 35, the alarm sound is issued from the speaker 51, and the alarm display is generated on the display unit 52. Accordingly, when the weight of the load on the fork 15 exceeds the limit load weight, warning is given to the operator by the issuance of the alarm, resulting in that the safety can be enhanced.

Fifth Embodiment

Figure 7:
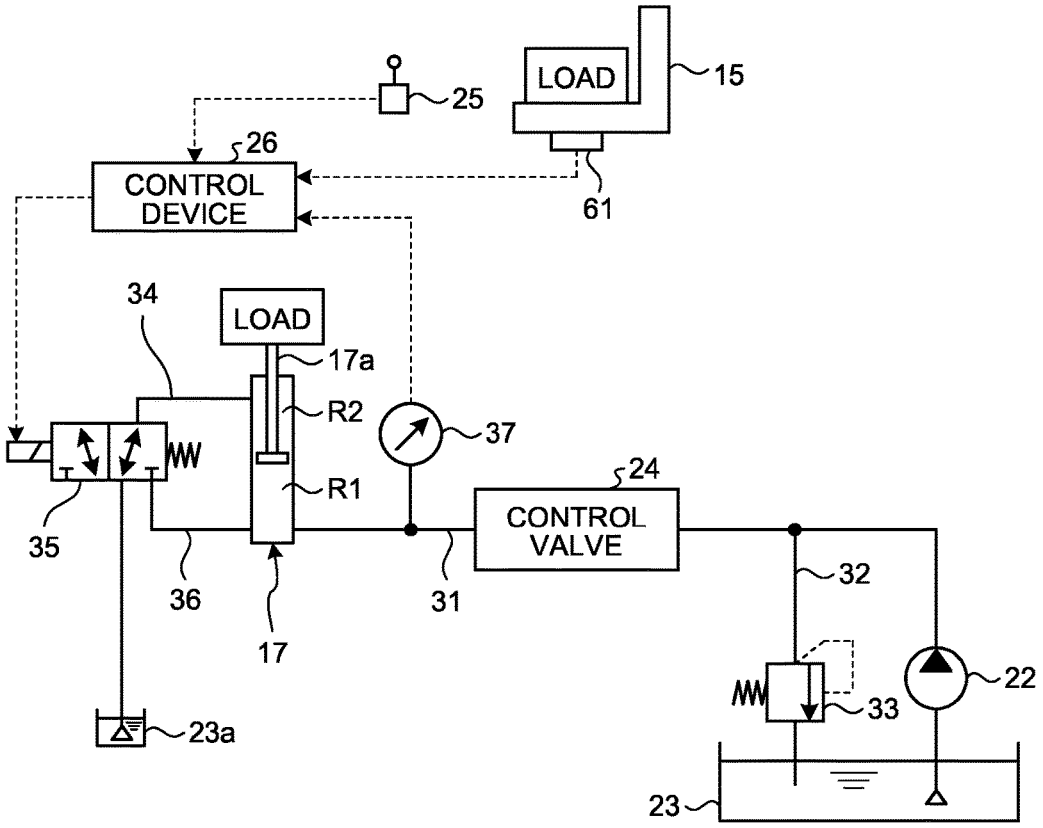
FIG. 7 is a hydraulic pressure circuit diagram of a lift cylinder in a forklift according to a fifth embodiment of the present invention.

FIG. 7 is a hydraulic pressure circuit diagram of a lift cylinder in a forklift according to a fifth embodiment of the present invention. The basic configuration of the forklift according to the present embodiment is almost equal to that described above in the first embodiment. Therefore, the present embodiment will be described with reference to FIG. 1. The components having the function same as the function of the components in the above-mentioned embodiment are identified by the same numerals, and the detailed description will not be repeated.

As illustrated in FIGS. 1 and 7, in the forklift according to the fifth embodiment, one end of a hydraulic pressure supply line 31 is connected to a tank 23, while the other end thereof is connected to a head-side chamber R1 in a lift cylinder 17. A pump 22 and a control valve 24 are mounted on the hydraulic pressure supply line 31. One end of a hydraulic pressure exhaust line 34 is connected to a rod-side chamber R2 in the lift cylinder 17, and the other end is connected to a tank 23*a*. A changeover valve 35 is provided on the hydraulic pressure exhaust line 34. One end of a hydraulic pressure communication line 36 is connected to the changeover valve 35, while the other end thereof is connected to the head-side chamber R1 in the lift cylinder 17. The changeover valve 35 allows the rod-side chamber R2 and the head-side chamber R1 in the lift cylinder 17 to communicate with each other by the hydraulic pressure exhaust line 34 and the hydraulic pressure communication line 36 during energization.

A pressure sensor 37 detects hydraulic pressure between the control valve 24 and the lift cylinder 17 on the hydraulic pressure supply line 31, i.e., hydraulic pressure applied to the head-side chamber R1 in the lift cylinder 17, and outputs the detected pressure to a control device 26. A load cell (distortion sensor, or the like) 61 is mounted on a fork 15. The load cell 61 detects stress (distortion, or the like) applied on the fork 15, and outputs the detected value to the control device 26. The control device 26 switches the changeover valve 35 based upon the hydraulic pressure applied to the chamber R1 and detected by the pressure sensor 37, or the stress applied on the fork 15 and detected by the load cell 61.

Specifically, when a weight of a load on the fork 15 exceeds a limit load weight, the control device 26 changes the pressure balance between the hydraulic pressure in the head-side chamber R1 and the hydraulic pressure in the rod-side chamber R2 in the lift cylinder 17 by the changeover valve 35 to restrict the operation of the lift cylinder 17. More specifically, when the weight of the load on the fork 15 exceeds the limit load weight, i.e., when the hydraulic pressure applied to the chamber R1 and detected by the pressure sensor 37 exceeds limit hydraulic pressure corresponding to the limit load weight or when the stress applied to the fork 15 and detected by the load cell 61 exceeds limit stress corresponding to the limit load weight, the control device 26 energizes the changeover valve 35 to be in a communication position, thereby allowing the rod-side chamber R2 and the head-side chamber R1 in the lift cylinder 17 to communicate with each other.

With this configuration, when an operator operates the operation device 25 to output an operation signal for lifting the fork 15, the control device 26 drives the pump 22 and drives the control valve 24 based upon the operation signal from the operation device 25. Specifically, the control device 26 supplies predetermined hydraulic pressure to the head-side chamber R1 in the lift cylinder 17 via the hydraulic pressure supply line 31 by the control valve 24. With this operation, a rod 17*a* moves up in the lift cylinder 17 to move a wire 19 via a guide roller 18, whereby the fork 15 is pulled and lifted up. Therefore, the load can be lifted.

In this case, when determining that the hydraulic pressure applied to the chamber R1 exceeds the limit hydraulic pressure or that the stress applied to the fork 15 exceeds the limit stress, the control device 26 energizes the changeover valve 35 to allow the rod-side chamber R2 and the head-side chamber R1 in the lift cylinder 17 to communicate with each other by the hydraulic pressure exhaust line 34 and the hydraulic pressure communication line 36. Therefore, even when the hydraulic pressure is supplied to the head-side chamber R1 in the lift cylinder 17, this hydraulic pressure flows into the rod-side chamber R2 through the hydraulic pressure exhaust line 34 and the hydraulic pressure communication line 36, whereby the hydraulic pressure in the head-side chamber R1 and the hydraulic pressure in the rod-side chamber R2 become almost equal to each other. Accordingly, the lift cylinder 17 cannot move up the rod 17*a*. In other words, when a load with a weight exceeding the limit load weight is placed on the fork 15, the control device 26 restricts the elevating motion of the fork 15 to prevent the damage on various components including the fork 15 and the lift cylinder 17.

As described above, in the forklift according to the fifth embodiment, when determining that the hydraulic pressure applied to the chamber R1 exceeds the limit hydraulic pressure or that the stress applied to the fork 15 exceeds the limit stress, the control device 26 restricts the operation of the lift cylinder 17 by the changeover valve 35. Therefore, when a load with a weight exceeding the limit load weight is placed on the fork 15, the control device 26 restricts the elevating motion of the fork 15 to prevent the damage on various components. Whether a load with a weight exceeding the limit load weight is placed on the fork 15 or not is determined by the pressure sensor 37 and the load cell 61. The multiple detecting methods described above can enhance reliability, whereby safety can further be enhanced.

Sixth Embodiment

Figure 8:
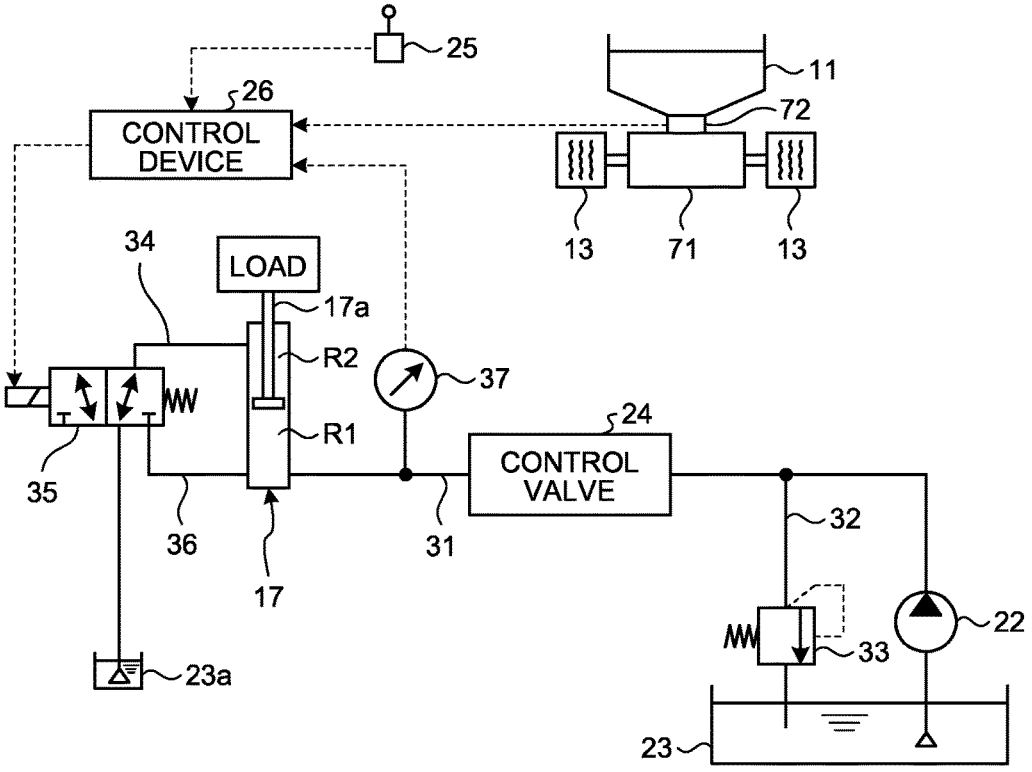
FIG. 8 is a hydraulic pressure circuit diagram of a lift cylinder in a forklift according to a sixth embodiment of the present invention.

FIG. 8 is a hydraulic pressure circuit diagram of a lift cylinder in a forklift according to a sixth embodiment of the present invention. The basic configuration of the forklift according to the present embodiment is almost equal to that described above in the first embodiment. Therefore, the present embodiment will be described with reference to FIG. 1. The components having the function same as the function of the components in the above-mentioned embodiment are identified by the same numerals, and the detailed description will not be repeated.

As illustrated in FIGS. 1 and 8, in the forklift according to the sixth embodiment, one end of a hydraulic pressure supply line 31 is connected to a tank 23, while the other end thereof is connected to a head-side chamber R1 in a lift cylinder 17. A pump 22 and a control valve 24 are mounted on the hydraulic pressure supply line 31. One end of a hydraulic pressure exhaust line 34 is connected to a rod-side chamber R2 in the lift cylinder 17, and the other end is connected to a tank 23*a*. A changeover valve 35 is provided on the hydraulic pressure exhaust line 34. One end of a hydraulic pressure communication line 36 is connected to the changeover valve 35, while the other end thereof is connected to the head-side chamber R1 in the lift cylinder 17. The changeover valve 35 allows the rod-side chamber R2 and the head-side chamber R1 in the lift cylinder 17 to communicate with each other by the hydraulic pressure exhaust line 34 and the hydraulic pressure communication line 36 during energization.

A pressure sensor 37 detects hydraulic pressure between the control valve 24 and the lift cylinder 17 on the hydraulic pressure supply line 31, i.e., hydraulic pressure applied to the head-side chamber R1 in the lift cylinder 17, and outputs the detected pressure to a control device 26. A load cell 72 is mounted between a forklift body 11 and a rear axle mount 71 of rear wheels 13. The load cell 72 detects a load (compressive load) between the forklift body 11 and the rear axle mount 71, and outputs the detected load to the control device 26. The control device 26 switches the changeover valve 35 based upon the hydraulic pressure applied to the chamber R1 and detected by the pressure sensor 37, or the stress applied to the forklift body 11 and detected by the load cell 72.

Specifically, when a weight of a load on the fork 15 exceeds a limit load weight, the control device 26 changes the pressure balance between the hydraulic pressure in the head-side chamber R1 and the hydraulic pressure in the rod-side chamber R2 in the lift cylinder 17 by the changeover valve 35 to restrict the operation of the lift cylinder 17. More specifically, when the weight of the load on the fork 15 exceeds the limit load weight, i.e., when the hydraulic pressure applied to the chamber R1 and detected by the pressure sensor 37 exceeds limit hydraulic pressure corresponding to the limit load weight, or when the load detected by the load cell 72 is less than a limit load corresponding to the limit load weight, the control device 26 energizes the changeover valve 35 to be in a communication position, thereby allowing the rod-side chamber R2 and the head-side chamber R1 in the lift cylinder 17 to communicate with each other.

The fork 15 is mounted on the front of the forklift body 11. Therefore, when a load is placed on the fork 15, the load on the front part of the forklift body 11 increases, while the load on the rear part of the forklift body 11 decreases. Specifically, the load cell 72 functions as a wheel vertical load detecting sensor that detects a wheel vertical load on the side opposite to the side where the fork 15 is mounted on the forklift body 11.

With this configuration, when an operator operates an operation device 25 to output an operation signal for lifting the fork 15, the control device 26 drives the pump 22 and drives the control valve 24 based upon the operation signal from the operation device 25. Specifically, the control device 26 supplies predetermined hydraulic pressure to the head-side chamber R1 in the lift cylinder 17 via the hydraulic pressure supply line 31 by the control valve 24. With this operation, a rod 17*a* moves up in the lift cylinder 17 to move a wire 19 via a guide roller 18, whereby the fork 15 is pulled and lifted up. Therefore, the load can be lifted.

In this case, when determining that the hydraulic pressure applied to the chamber R1 exceeds the limit hydraulic pressure or that the vertical load of the rear wheel 13 becomes less than a limit load, the control device 26 energizes the changeover valve 35 to allow the rod-side chamber R2 and the head-side chamber R1 in the lift cylinder 17 to communicate with each other by the hydraulic pressure exhaust line 34 and the hydraulic pressure communication line 36. Therefore, even when the hydraulic pressure is supplied to the head-side chamber R1 in the lift cylinder 17, this hydraulic pressure flows into the rod-side chamber R2 through the hydraulic pressure exhaust line 34 and the hydraulic pressure communication line 36, whereby the hydraulic pressure in the head-side chamber R1 and the hydraulic pressure in the rod-side chamber R2 become almost equal to each other. Accordingly, the lift cylinder 17 cannot move up the rod 17*a*. In other words, when a load with a weight exceeding the limit load weight is placed on the fork 15, the control device 26 restricts the elevating motion of the fork 15 to prevent the damage on various components including the fork 15 and the lift cylinder 17.

As described above, in the forklift according to the sixth embodiment, when determining that the hydraulic pressure applied to the chamber R1 of the lift cylinder 17 exceeds the limit hydraulic pressure or that the vertical load of the rear wheel 13 becomes less than the limit load, the control device 26 restricts the operation of the lift cylinder 17 by the changeover valve 35. Therefore, when a load with a weight exceeding the limit load weight is placed on the fork 15, the control device 26 restricts the elevating motion of the fork 15 to prevent the damage on various components. Whether a load with a weight exceeding the limit load weight is placed on the fork 15 or not is determined by the pressure sensor 37 and the load cell 72. The multiple detecting methods described above can enhance reliability, whereby safety can further be enhanced.

In the fifth and sixth embodiments described above, whether a load with a weight exceeding the limit load weight is placed on the fork 15 or not is determined by using the pressure sensor 37 and the load cells 61 and 72. However, this determination may be made by only one of the load cells 61 and 72. This determination may be made by using two load cells 61 and 72, or the pressure sensor 37 and one of the load cells 61 and 72. In this case, the configuration can be simplified by using only one of the load cells 61 and 72, and reliability can be enhanced by using the pressure sensor 37 and the load cells 61 and 72.

REFERENCE SIGNS LIST

11 forklift body
12 front wheel
13 rear wheel
14 mast
15 fork
16 tilt cylinder (second fluid pressure cylinder)
17 lift cylinder (first fluid pressure cylinder)
21 drive source
22 pump
23, 23*a* tank
24 control valve
25 operation device
26 control device (operation restricting device)
31 hydraulic pressure supply line (fluid pressure supply line)
31*a* first hydraulic pressure supply line (fluid pressure supply line)
31*b* second hydraulic pressure supply line (fluid pressure supply line)
33, 33*a*, 33*b* relief valve
34 hydraulic pressure exhaust line (fluid pressure exhaust line)
35 changeover valve (operation restricting device)
36 hydraulic pressure communication line
37 pressure sensor
41 relief valve (operation restricting device)
51 speaker
52 display unit
61, 72 load cell

The invention claimed is:

1. A forklift comprising:

a forklift body capable of travelling;

a fork supported to the forklift body so as to be capable of moving vertically;

a first fluid pressure cylinder capable of moving the fork up and down;

a fluid pressure supply line capable of supplying fluid pressure to a first chamber on a head-side in the first fluid pressure cylinder;

a fluid pressure exhaust line connected to a second chamber on a rod-side in the first fluid pressure cylinder and capable of exhausting fluid pressure from the second chamber;

a changeover valve provided on the fluid pressure exhaust line;

a pressure sensor which detects fluid pressure corresponding to a load weight held on the fork, in the first chamber;

a tank connected to the changeover valve through the fluid pressure exhaust line and configured to store a working fluid that is exhausted from the second chamber;

a communication line, one end of which being connected to the changeover valve and the other end of which being connected to the first chamber, and configured to allow the first chamber and the second chamber to directly communicate with each other without passing through the tank; and an operation restricting device configured to change a pressure balance between fluid pressure in the first chamber and fluid pressure in the second chamber by the changeover valve to restrict an operation of the first fluid pressure cylinder, when a weight of a load on the fork, obtained based on the detected fluid pressure, exceeds a threshold value set in advance, wherein the changeover valve is a valve capable of switching to be in an exhaust position for connecting the second chamber and the tank through the fluid pressure exhaust line, and in a communication position for directly connecting the second chamber and the first chamber through the fluid pressure exhaust line and the communication line without passing through the tank, the operation restricting device switches the changeover valve to be in the communication position to allow the first chamber and the second chamber to communicate with each other and causes the fluid pressure supplied to the first chamber to directly flow into the second chamber through the fluid pressure exhaust line and the communication line without passing through the tank to make the fluid pressure in the first chamber and the fluid pressure in the second chamber equal to each other, when a weight of a load on the fork exceeds the threshold value.

2. The forklift according to claim 1, wherein the changeover valve has an open pressure set corresponding to the threshold value.

3. The forklift according to claim 2, wherein the fork is supported to the forklift body so as to be capable of tilting, and capable of tilting by a second fluid pressure cylinder, the fluid pressure supply line includes a first fluid pressure supply line capable of supplying fluid pressure to the head-side of the first fluid pressure cylinder and a second fluid pressure supply line capable of supplying fluid pressure to the head-side of the second fluid pressure cylinder, a first relief valve and a second relief valve are provided on the first fluid pressure supply line and the second fluid pressure supply line, respectively, the first relief valve has an open pressure set according to the threshold value, and a hydraulic pressure which is a criteria for switching the changeover valve corresponds to the threshold value, and the hydraulic pressure is set lower than the open pressure of the first relief valve.

4. The forklift according to claim 2, wherein the operation restricting device restricts an operation of an operation device for moving up the fork, when a weight of a load on the fork exceeds the threshold value.

5. The forklift according to claim 2, wherein the operation restricting device issues an alarm, when a weight of a load on the fork exceeds the threshold value.

6. The forklift according to claim 1, wherein the fork is supported to the forklift body so as to be capable of tilting, and capable of tilting by a second fluid pressure cylinder, the fluid pressure supply line includes a first fluid pressure supply line capable of supplying fluid pressure to the head-side of the first fluid pressure cylinder and a second fluid pressure supply line capable of supplying fluid pressure to the head-side of the second fluid pressure cylinder, a first relief valve and a second relief valve are provided on the first fluid pressure supply line and the second fluid pressure supply line, respectively, the first relief valve has an open pressure set according to the threshold value, and a hydraulic pressure which is a criteria for switching the changeover valve corresponds to the threshold value, and the hydraulic pressure is set lower than the open pressure of the first relief valve.

7. The forklift according to claim 6, wherein
the operation restricting device restricts an operation of an operation device for moving up the fork, when a weight of a load on the fork exceeds the threshold value.

8. The forklift according to claim 6, wherein
the operation restricting device issues an alarm, when a weight of a load on the fork exceeds the threshold value.

9. The forklift according to claim 1, wherein
the operation restricting device restricts an operation of an operation device for moving up the fork, when a weight of a load on the fork exceeds the threshold value.

10. The forklift according to claim 9, wherein
the operation restricting device issues an alarm, when a weight of a load on the fork exceeds the threshold value.

11. The forklift according to claim 1, wherein
the operation restricting device issues an alarm, when a weight of a load on the fork exceeds the threshold value.

12. The forklift according to claim 1, further comprising:
a wheel vertical load detecting sensor configured to detect a wheel vertical load on a side opposite to the side where the fork is mounted on the forklift body, wherein
the operation restricting device restricts the operation of the first fluid pressure cylinder, when the wheel vertical load becomes less than a limit vertical load set in advance.

* * * * *